US005127443A

United States Patent [19]

Ducamp et al.

[11] Patent Number: 5,127,443

[45] Date of Patent: Jul. 7, 1992

[54] NEEDLE FOR CONSTRUCTION OF THREE DIMENSIONAL FABRIC

[75] Inventors: Jean P. Ducamp, Le Haillan; Etienne Lemaire; Robert Montignac, both of Saint Medard en Jalles, all of France

[73] Assignee: Aerospatiale Societe Nationale Industrielle, Paris, France

[21] Appl. No.: 488,698

[22] Filed: Mar. 5, 1990

[30] Foreign Application Priority Data

Mar. 6, 1989 [FR] France ..... 89 02905

[51] Int. Cl.[5] ..... D03D 47/04

[52] U.S. Cl. ..... 139/22; 66/1 R; 139/14; 223/104

[58] Field of Search ..... 139/11, 449, 14, 22; 223/104, 103, 102; 66/1 R, 11, 83, 88, 190, 12

[56] References Cited

U.S. PATENT DOCUMENTS 2,409,445 10/1946 Newman ..... 223/102 X 4,133,339 1/1979 Naslund ..... 223/102 X 4,526,026 7/1985 Krauland, Jr. ..... 139/14

4,779,429 10/1988 Banos ..... 66/83

*Primary Examiner*—Andrew M. Falik

*Attorney, Agent, or Firm*—Toren, McGeady & Associates

[57] ABSTRACT

A needle for carrying out operation with flexible cords, roves or threads, for fabricating armatures by a multidirectional weaving, the needle having an elongated body having a free end of the body, and an eye being a closed loop which extends outside the body of the needle and which is shaped and disposed relative to the body so as to avoid laterally projecting beyond the space defined by the width of the elongated body. The loop is delimited by two parallel side walls which extend transversely relative to the elongated body from a side of the elongated body and by a pin for guiding the cords, roves or threads which interconnects the two side walls.

14 Claims, 3 Drawing Sheets

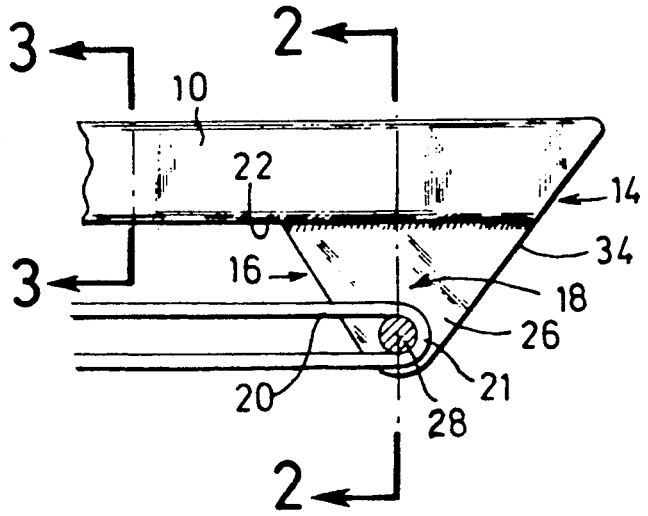
FIG.1
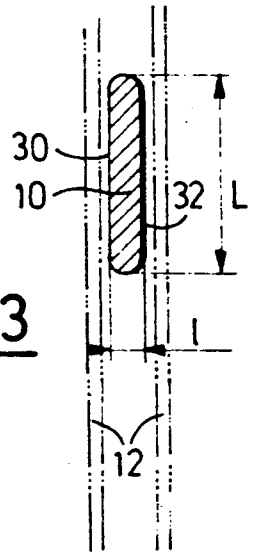
FIG.3
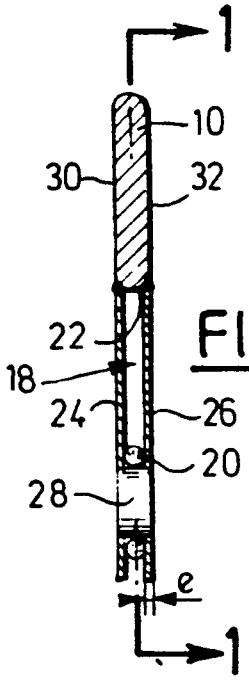
FIG.2
FIG.4
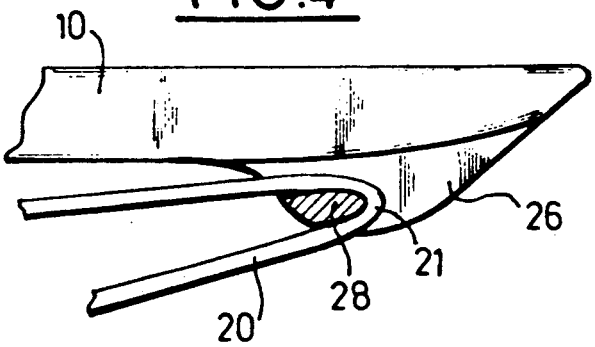

FIG.5
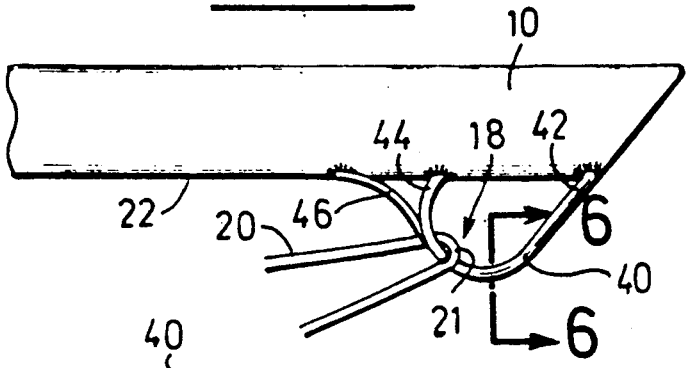
FIG.6A
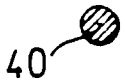
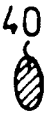
FIG.6B
FIG.7
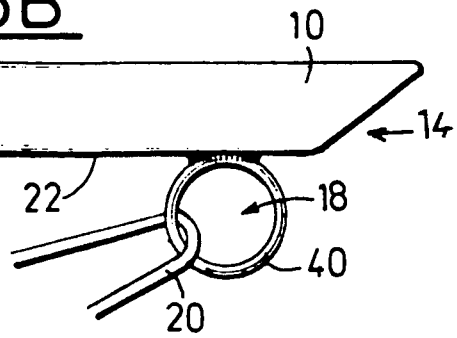
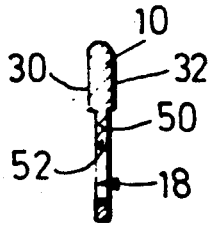
FIG.9
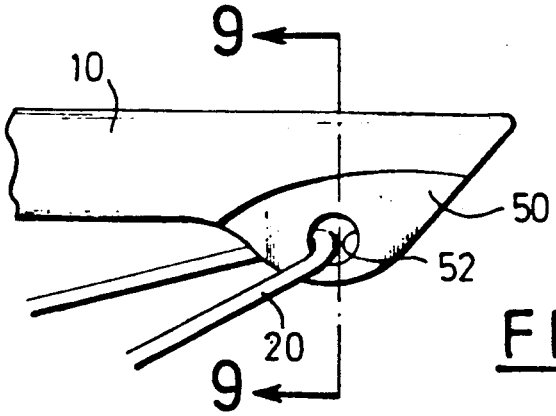
FIG.8

FIG.10A
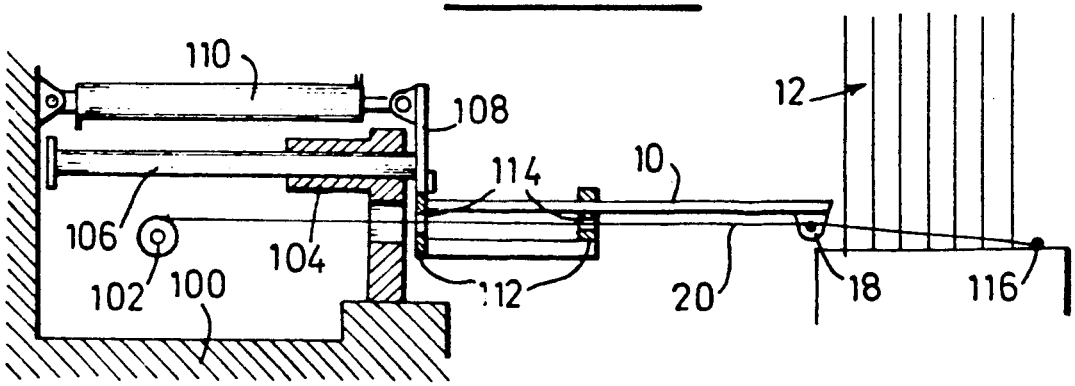
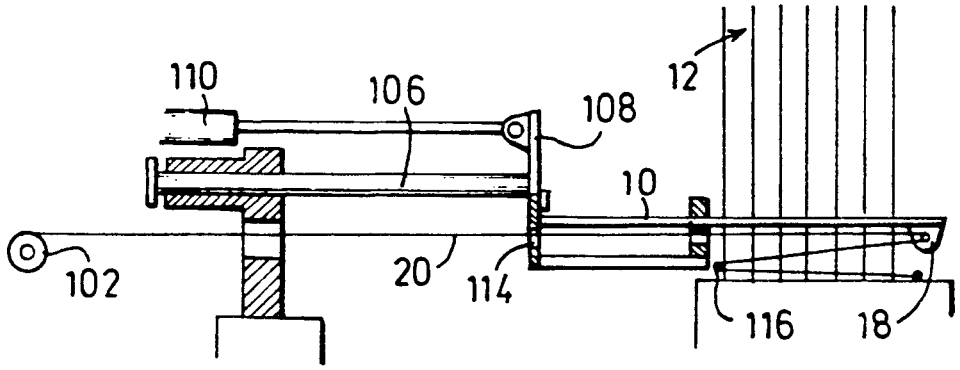
FIG.10B
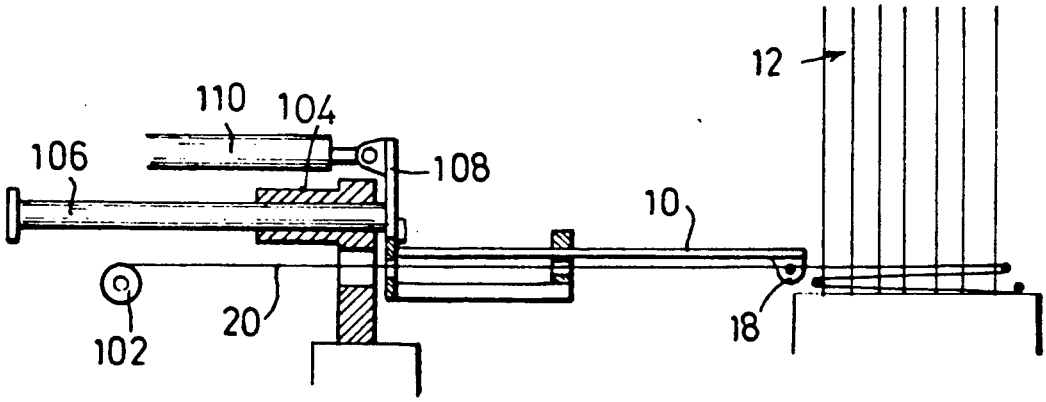
FIG.10C

NEEDLE FOR CONSTRUCTION OF THREE DIMENSIONAL FABRIC

BACKGROUND OF THE INVENTION

The invention relates to a needle for carrying out operations with flexible cords, roves or threads.

A needle of this type finds its application in particular in the field of the fabrication of armatures by a multidirectional weaving. Such armatures are employed, after impregnation with a suitable binder and polymerization, for producing structural units of a composite material which can be subjected to very great mechanical and thermal stresses.

A particular purpose of the invention is to permit the weaving of a structure which will comprise continuous fibers oriented in at least three directions generally perpendicular to one another.

The general principle of the weaving of such structures consists in disposing fibers in two directions between and around a third direction materialized either by rigid rods which are for example metal rods, or by taut roves, or by rods of composite material constituted by impregnated, hardened and calibrated roves.

A known technique for producing such a structure consists in "depositing" the fibers by means of hollow needles which receive and convey the fibers through the network and then abandon them upon a reverse movement, these fibers being maintained taut in their forward travel by maintaining elements.

In the known technique, the fibers are conveyed in hollow needles whose elongated body is a stem of substantially rectangular flattened section whose reduced width permits the passage between the metal rods or taut roves.

The hollow needles employed in this technique must be sufficiently rigid to avoid deviating from their direction under the effect of forces applied thereto which are due to the driving of the fibers in such manner as to avoid deteriorating the network of vertical rods and deteriorating the fibers, they convey. The needles must be easy to employ when preparing the device before the weaving, in particular permit the introduction of the fibers in the stem.

The known needles are made from a tube having a thin wall which is flattened until there is obtained the thickness which is compatible with the width of the meshes of the network, the end of the tube being cut on the bevel from which burrs are carefully removed.

These needles present many drawbacks. It is particularly difficult to thread the threads or the fibers in their narrow and long body, for example 300 to 500 mm. There is a risk of a clogging of the fibers in the tube by accumulation of small particles or fibrillae which slow down the weaving process. It has also been found that there is a degradation of the fiber at the stage of the penetration into the network owing to an exaggerated bending of the fiber at the bevelled free end of the needle, in particular in the case of the use of fragile fibers having a high modulus of elasticity. This drawback is particularly harmful since it affects the final mechanical characteristics of the woven product. Lastly, owing to their fragility, the hollow needles are often destroyed by buckling.

SUMMARY OF THE INVENTION

An object of the invention is to overcome the drawbacks just mentioned and to provide a needle structure which is easy to produce, in particular in mass production, convenient and reliable in use, and capable of being adapted to the various types of fibers employed in the fabrication of composite materials having high mechanical and thermal performances.

The invention therefore provides a needle of the type comprising an elongated body and an eye formed in the vicinity of its end, wherein the eye is a closed loop which extends outside the body of the needle.

The loop is shaped and disposed relative to the body in such manner as to avoid laterally projecting beyond the body of the needle.

According to a preferred embodiment of the invention, the loop is delimited by two parallel side walls which extend from a side of the elongated body and by a thread-guiding pin which interconnects the two side walls.

The section of the guide pin has a profile adapted to the nature of the threads and, if the elongated body has a substantially rectangular section, the two guiding side walls extend in a direction parallel to the two large lateral sides of the elongated body and are spaced apart a distance less than or equal to the width of the rectangular section of the body.

According to another embodiment of the invention, the loop is constituted by a ring which is added to one of the sides of the elongated body and whose section has a profile adapted to the nature of the threads.

In the case where the elongated body has a substantially rectangular section, the ring extends in a plane parallel to the two large sides of the body.

According to a further embodiment of the invention, the loop is an aperture formed in a portion of the body which transversely projects from one side of the body. When the elongated body has a substantially rectangular section, the portion in which the aperture is formed is a thinned-down portion which extends in a direction parallel to the two large sides of the body.

Whatever be the envisaged embodiment, the loop may be disposed set back relative to the free end of the elongated body of the needle, this body being preferably a solid body.

The invention also provides a device for using a needle such as that previously defined, of the type in which the body of the needle is fixed to a driving element undergoing a reciprocating movement, wherein the driving element includes at least one aperture for guiding the threads and formed in a member connected to move with said element for the purpose of maintaining the threads substantially parallel to the elongated body.

DESCRIPTION OF THE DRAWINGS

The following description with reference to the accompanying drawings given as non-limitative examples, will explain how the invention may be carried out.

FIG. 1 is a sectional view taken on line 1—1 of FIG. 2 of the end of a preferred embodiment of a needle according to the invention.

FIG. 2 is a sectional view taken on line 2—2 of FIG. 1.

FIG. 3 is a sectional view taken on line 3—3 of FIG. 1.

FIG. 4 is a view similar to FIG. 1 of a variant of the first embodiment.

FIG. 5 is an elevational view of the end of a third embodiment of a needle according to the invention.

FIGS. 6A and 6B represent two possible sections taken on line 6—6 of FIG. 5.

FIG. 7 is a view similar to FIG. 5 of another embodiment of the invention.

FIG. 8 is a view similar to FIG. 5 of yet another embodiment of a needle according to the invention.

FIG. 9 is a sectional view taken on line 9—9 of FIG. 8.

FIGS. 10A, 10B and 10C are three diagrams of a device for weaving a tridimensional structure by means of needles arranged in accordance with the teaching of the invention, this device being shown in three successive positions in its operation.

DESCRIPTION OF THE PREFERRED EMBODIMENT

The needle shown in FIGS. 1 to 3 comprises an elongated solid body 10 only the end of which is shown in FIG. 1.

The body 10 has a substantially rectangular section having a width "1" and a length "L".

The section of the body is substantially rectangular and is delimited by two parallel lateral large sides and two upper and lower small sides.

As can be seen in FIG. 3, the very small width "1" between the two lateral sides must permit the passage of the body 10 of the needle for example between two vertical rods 12 shown in dot-dash lines.

The free end 14 of the rectilinear elongated body 10 is bevelled.

In this first embodiment, the eye 16 of the needle is a loop 18 through which the fibers or the roves 20 pass.

As can be seen in FIG. 2, the loop 18 is delimited by the small inner side 22 of the elongated body 10, by two triangular and parallel side walls 24 and 26 and by a guide pin 28.

The two side walls 24 and 26 extend transversely relative to the elongated body 10 from the small side 22 in a direction parallel to the two large sides 30 and 32 of the body.

In the embodiment shown in FIGS. 1 to 3, the two side walls 24 and 26 are added by welding to the elongated metal body 10 and are flush with the two parallel large sides 30 and 32.

The guide pin closing the loop 18 is a profiled pin having a circular section.

The front side 34 of the triangular side walls 24 and 26 is in the extension of the bevelled end 14 of the elongated body 10. The side walls 24 and 26 also serve to ensure a good maintenance of the fibers 20 and extend downwardly below the guide pin 28. As an example, the length "L" of the rectangular section may be equal to 6 mm, its width "1" equal to 0.5 mm, the thickness "e" of the side walls equal to 0.05 mm and the diameter of the cylindrical profile pin 28 between 1 and 2 mm.

The needle in the embodiment just described permits eliminating the tubular part of the body proper and replacing it by a solid body which has high mechanical characteristics and may be for example made by rolling a piano wire. This design permits supporting the fibers or the roves by the needle only in regions strictly necessary for the guiding, i.e. in the loop forming the eye, and leaving them free elsewhere so as to avoid the phenomena of clogging, creating radii of curvature of the fibers which are adapted to their specific mechanical characteristics by determining a minimum admissible radius of curvature as a function of the moduli of elasticity of the fibers, and protecting the bent part 21 of the fibers during the stage of the penetration into the network in particular by the fact that the loop is positioned set back from the free end of the body 10.

The embodiment shown in FIG. 4 differs from the preceding embodiment only by the outer contour of the side walls which are no longer perfectly triangular but slightly rounded. It will also be noticed that the contour of the section of the pin 28 has a profile which is substantially in the shape of an ellipse which may be employed with fibers 20 for which a more acute maximum angle of curvature of their portions 21 is allowable.

In these first two embodiments, the arrangement of the side walls is such that the loop does not laterally project beyond the space defined by the width "1" of the elongated body 10.

In the embodiment shown in FIG. 5, the body 10 is identical to that shown in FIGS. 1 to 3 and has in particular a rectangular section.

Added to the small side 22 is a metal ring 40 whose two ends 42 and 44 are for example welded.

The ring 40 extends transversely in the plane parallel to the lateral sides 30, 32 of the elongated body 10 and forms a loop 18 through which the fibers 20 pass.

The ring is a metal ring whose section may be circular or elliptical as represented in FIGS. 6A and 6B.

The ring 40 may be reinforced by a welded rear tab 46 for resisting tensile stress exerted on the ring by the fibers 20 in the forward travel of the needle when penetrating the weaving structure.

In the embodiment shown in FIG. 7 which is very close to that shown in FIG. 5, the loop 18 is a complete circular ring 40 which is welded to the lower small side 22 of the body 10 and also extends in the plane of the body 10 in a direction parallel to its two large sides 30 and 32.

In the case of the embodiments shown in FIGS. 5 to 7, the thickness of the ring 40 is chosen to be as small as possible so that the lateral overall size of the latter plus the thickness of the fibers on each side of its section, does not exceed the width "1" of the elongated body 10.

In the embodiments shown in FIGS. 8 and 9, the end of the body 10 having a rectangular section comprises a thinned-down portion 50 which projects transversely relative to its general direction and in which is provided an aperture 52 which constitutes the loop 18 through which the fibers 20 pass.

The edge of the aperture 52 may be profiled and in particular rounded so as to avoid damaging the fibers as they rub against this edge.

The thinned-down portion 50 is parallel to the large lateral sides 30 and 32 of the body 10 and extends transversely from the lower small side 22.

The outer contour of the thinned-down portion 50 may have various shapes, for example those shown in FIG. 1 or 4.

FIGS. 10A to 10C diagrammatically represent a tridimensional weaving machine equipped with solid needles arranged in accordance with the teaching of the invention. The machine comprises a frame 100 on which a reel 102 is rotatively mounted and on which is slidably guided in a sleeve 104 a slide 106 of a structure 108 for driving a needle 10 in a reciprocating motion.

The driving structure 108 may be made to move for example by means of a double-acting cylinder device 110.

In the embodiment shown in FIGS. 10A to 10C, the needle 10 is of the type shown in FIGS. 1 to 3 and causes the fibers 20 of the reel 102 to pass through a network of vertical rods 12 in a reciprocating motion.

According to the invention, the structure 108 comprises two added tabs 112 each defining an aperture 114 of large size which serves to guide and maintain the fibers 20 alongside the body 10 of the needle in the course of the movements of the latter.

In starting in the position shown in FIG. 10A, the actuation of the cylinder device causes the needle 10 to penetrate the vertical network 12 until its free end 14 including the eye 18 extends beyond the network, i.e. to the right as viewed in FIG. 10B. In this position, a bar 116 for retaining the fibers 20 is introduced and the cylinder device can cause the return movement of the needle 10 which "deposits" the fibers 20 in the network 12 and reaches the position shown in FIG. 10C which is similar to that shown in FIG. 10A after a forward-rearward deposit of the fibers 20.

Throughout these movements, the fibers 20 were guided and maintained substantially parallel to the body 10 owing to the effect of the guide apertures 114 of the structure 108.

What is claimed is:

1. A needle for carrying out operations with flexible cords, roves or threads, for fabricating armatures by a multi-directional weaving, said needle comprising an elongated body having a free end, and an eye provided in the vicinity of the free end of the body, the eye being a closed loop which extends outside the body of the needle and which is shaped and disposed relative to the body so as to avoid laterally projecting beyond the space defined by the width of the elongated body, the loop being delimited by two parallel side walls which extend transversely relative to the elongated body from a side of the elongated body, and further delimited by a pin for guiding the cords, roves or threads which interconnects the two side walls.

2. A needle according to claim 1, therein the guide pin has a cross-section with a substantially circular profile.

3. A needle according to claim 1, wherein the elongated body comprises two large lateral sides and two sides smaller than the large sides which define a substantially rectangular section of the body, and the two side walls extend in a direction parallel to said two large lateral sides.

4. A needle according to claim 1, wherein the loop is set back relative to said free end of the elongated body.

5. A needle according to claim 1, wherein the body is a solid body.

6. A needle for carrying out operations with flexible cords, roves or threads, for fabricating armatures by a multi-directional weaving, said needle comprising an elongated body having a free end, and a eye provided in the vicinity of the free end of the body, the eye being a closed loop which extends outside the body of the needle and which is shaped and disposed relative to the body so as to avoid laterally projecting beyond the space defined by the width of the elongated body, the loop being a ring mounted on a side of the elongated body, which ring has a perimeter that is continuously connected encircling band.

7. A needle according to claim 6, wherein the ring has a substantially circular profile cross-section.

8. A needle according to claim 7, wherein the elongated body comprises two large lateral sides and two sides smaller than the large sides which define a substantially rectangular section of the body, and the ring extends in a plane parallel to said two large lateral sides.

9. A needle according to claim 8, wherein the loop is set back relative to said free end of the elongated body.

10. A needle according to claim 6, wherein the body is a solid body.

11. A needle for carrying out operations with flexible cords, roves or threads, for fabricating armatures by a multi-directional weaving, said needle comprising an elongated body having a free end, and an eye provided in the vicinity of the free end of the body, the eye being a closed loop which extends outside the body of the needle which is shaped and disposed relative to the body so as to avoid laterally projecting beyond the space defined by the width of the elongated body, the elongated body comprising a portion which transversely projects from a side of the body and an aperture in said portion defined said loop, the elongated body further comprising two large lateral sides and two sides smaller than the large sides which define a substantially rectangular section of the body and said portion is a thinned-down portion which extends in a direction parallel to said two large sides.

12. A needle according to claim 11, wherein the loop is set back relative to said free end of the elongated body.

13. A needle according to claim 11, wherein the body is a solid body.

14. In combination with a needle driving structure, a device for using a needle for carrying out operations with flexible cords, roves or threads, said needle comprising an elongated body having a free end, and an eye provided in the vicinity of the free end of the body, the eye being a closed loop which extends outside the body of the needle, said device comprising the driving structure for receiving the body of the needle in a fixed position in the driving structure, means for imparting to the driving structure a reciprocating motion, the driving structure comprising means defining at least one aperture for guiding the cords, roves or threads and maintaining the cords, roves or threads substantially parallel to the elongated body of the needle.

* * * * *